US009580898B2

(12) United States Patent
Wynne

(10) Patent No.: US 9,580,898 B2
(45) Date of Patent: Feb. 28, 2017

(54) LIQUID RUN-OFF DISPOSAL SYSTEM

(71) Applicant: Michael John Wynne, Osborne Park (AU)

(72) Inventor: Michael John Wynne, Osborne Park (AU)

( * ) Notice: Subject to any disclaimer, the term of this patent is extended or adjusted under 35 U.S.C. 154(b) by 0 days.

(21) Appl. No.: 15/044,583

(22) Filed: Feb. 16, 2016

(65) Prior Publication Data

US 2016/0160487 A1 Jun. 9, 2016

Related U.S. Application Data

(63) Continuation-in-part of application No. 14/479,667, filed on Sep. 8, 2014, now Pat. No. 9,290,924, which is a continuation-in-part of application No. 13/383,777, filed as application No. PCT/AU2010/000885 on Jul. 12, 2010, now Pat. No. 8,858,119.

(30) Foreign Application Priority Data

Jul. 13, 2009 (AU) ..... 2009906328
Dec. 14, 2009 (AU) ..... 2009906092

(51) Int. Cl.
*E03F 1/00* (2006.01)

(52) U.S. Cl.
CPC ..... *E03F 1/002* (2013.01); *E03F 1/003* (2013.01)

(58) Field of Classification Search
USPC ..... 405/43, 44, 46, 48
See application file for complete search history.

(56) References Cited

U.S. PATENT DOCUMENTS

| | | | |
|---|---|---|---|
| 3,645,100 | A | 2/1972 | La Monica |
| 3,973,407 | A | 8/1976 | Vecchio |
| 4,720,209 | A | 1/1988 | Iams |
| 4,759,661 | A | 7/1988 | Nichols et al. |
| 5,669,733 | A | 9/1997 | Daly et al. |
| 5,720,577 | A | 2/1998 | Sanders et al. |
| 6,612,777 | B2 | 9/2003 | Maestro |
| 7,207,747 | B1 | 4/2007 | England |
| 7,311,467 | B2 | 12/2007 | Moore, Jr. |
| 7,351,005 | B2 | 4/2008 | Potts |
| 2004/0184884 | A1 | 9/2004 | DiTullio |
| 2005/0074287 | A1 | 4/2005 | Brochu et al. |
| 2006/0182497 | A1 | 8/2006 | Potts |
| 2007/0154261 | A1 | 7/2007 | Brochu et al. |
| 2007/0262009 | A1 | 11/2007 | Fitzgerald |
| 2009/0067929 | A1 | 3/2009 | Brochu et al. |

OTHER PUBLICATIONS

Patent Examination Report No. 1 issued in Australian Patent Application No. 2015200412, Oct. 28, 2015, 6 pages.

*Primary Examiner* — Kyle Armstrong
(74) *Attorney, Agent, or Firm* — Hamre, Schumann, Mueller & Larson, P.C.

(57) ABSTRACT

A liquid run-off disposal system 100 comprising an elongate tank structure having one or more culvert sections 102 adapted to be arranged end to end in a substantially horizontal orientation below ground. Each culvert section 102 also includes a plurality of louvre-shaped inserts 114 provided in the sidewalls thereof wherein, in use, when liquid run-off is piped into the culvert section 102 it can drain away by soaking into the surrounding soil.

28 Claims, 11 Drawing Sheets

SECTION AC-AC
SCALE 1:1.5

SECTION E-E
SCALE 1:1.5

DETAIL A-D
SCALE 1:1.5

LIQUID RUN-OFF DISPOSAL SYSTEM

FIELD OF THE INVENTION

The present invention relates to a liquid run-off disposal system and relates particularly, though not exclusively, to such a disposal system for disposing of stormwater run-off.

BACKGROUND TO THE INVENTION

In Perth, Western Australia, because of the generally sandy soil, one of the most common methods for disposing of stormwater is to employ soakwells. A typical soakwell consists of a cylindrical section that is installed in a vertical orientation in the soil. It may have a plurality of apertures provided in the sidewall, and it is open at the bottom so that when water collects in the soakwell it can soak into the surrounding soil underneath. Downpipes connected to drains from roof guttering are plumbed into the sidewall of the soakwell so that stormwater run-off is safely directed and disposed of away from building foundations. Soakwells may also directly collect rainwater run-off from car park areas.

One of the problems with soakwells is their limited capacity. This means that the larger the impervious surface area that a building or development has requiring drainage of stormwater run-off, the more soakwells have to be installed. However installing soakwells is labour-intensive and expensive, as each soakwell first requires excavation of the soil at numerous locations over the site and then craning of the concrete cylinder into the excavated hole at many locations.

The present invention was developed with a view to providing a liquid run-off disposal system that is fully scalable, and simple, compact and easy to install compared to soakwells.

References to prior art in this specification are provided for illustrative purposes only and are not to be taken as an admission that such prior art is part of the common general knowledge in Australia or elsewhere.

SUMMARY OF THE INVENTION

According to one aspect of the present invention there is provided a liquid run-off disposal system comprising:

an elongate tank structure having one or more sections adapted to be arranged end to end in a substantially horizontal orientation below ground, each section of the tank structure taking the form of a culvert section having first and second sidewalls, in cross-sectional view the first and second sidewalls each include an inner surface and outer surface;

the first and second sidewalls each include a plurality of louvre-shaped inserts received in louvre-locating cavities provided therein, each louvre-locating cavity being in the form of a recessed portion of the sidewall, in which a part of the sidewall is shaped so as to have an angled profile in cross-section, wherein the angled profile of the louvre-locating cavities substantially increases the strength of the sidewall;

in cross-sectional view each louvre-shaped insert includes an upper surface and a lower surface which are substantially parallel to each other and are angled upwards from the outer surface to the inner surface, and for each insert the distance between the upper surface and the lower surface at the outer surface is the same so that each of the inserts have substantially the same height at the outer surface; and, the upper and lower surfaces are angled at such an angle and are of a length so as to substantially overlap in a horizontal direction so as to admit the exit of water but substantially inhibit the entry of soil wherein, in use, when liquid run-off is piped into the tank structure it can drain away by passing through the apertures and soaking into the surrounding soil.

Preferably the louvre-shaped inserts are inserted into matching louvre-locating cavities from the outside of the culvert section so that they pass through the sidewall, protruding inwardly and extending upwardly from the inner surface of the sidewall into the inside of the culvert section. Typically each louvre-shaped insert is of elongate configuration, having a substantially perpendicular face at each end; an outer face at an outer end that is open, in use, to the outside of the culvert section and which sits more or less flush with an outer surface of the sidewall, and an inner face at an inner end that is open, in use, to the inside of the culvert section. Advantageously the louvre-shaped insert is provided with a flange on its outer face designed to secure the insert in the louvre-locating cavity.

Preferably the outer face of each louvre-shaped insert is facing downwards, and is partially shielded within its louvre-locating cavity. Advantageously a part of the sidewall within the louvre-locating cavity, against which the flange of the louvre-shaped insert rests, turns at substantially a right-angle and returns back outwardly to a main outer surface of the sidewall. Preferably the part of the sidewall that forms the louvre-locating cavity, has a zig-zag profile in cross-section.

In a preferred embodiment each culvert section is of generally parabolic or semi-elliptical cross-section. Preferably each culvert section has an open base. Preferably each culvert section is provided with a reinforcing rib extending over an external circumference of the section from a base to an apex. Typically the reinforcing rib has a height dimension at the apex which is higher than a height of the sidewalls of the section, and a width dimension which is smaller at the apex than at the base. Preferably the reinforcing rib is of substantially rectangular cross-section, when viewed transversely of the rib, having an outer wall and two sidewalls.

In one embodiment, at the apex the height of the outer wall of the rib is between 15%-19% higher than the sidewalls of the section. Preferably at the apex the height of the outer wall of the rib is approximately 17% higher than the sidewalls of the section. Preferably at the apex the width of the outer wall of the rib is between 9% and 13% of the total length of the section. More preferably at the apex the width of the outer wall of the rib is approximately 11% of the total length of the section. Typically at the base the width of the outer wall of the rib is between 35%-45% of the total length of the section. More typically at the base the width of the outer wall of the rib is approximately 40% of the total length of the section.

Preferably between one quarter to one half of the length of the respective upper and lower surfaces of the louvre-shaped inserts overlap, measured in a vertical direction. More preferably about one third of the length of the respective upper and lower surfaces overlap, measured in a vertical direction. Advantageously the louvre-shaped inserts are provided in a uniform rectangular array comprising a plurality of rows and columns, the inserts in each row being arranged at spaced intervals, and the inserts in any row being offset horizontally from the inserts in an adjacent row.

Preferably the liquid run-off disposal system further comprises one or more vertical liners arranged at predetermined locations on top of the culvert sections for maintenance purposes and/or human access. Preferably each liner is provided with a manhole cover or a grating for back-pressure relief and to collect stormwater from sealed surfaces other than a building.

Preferably the first and second sidewalls each have a substantially constant thickness measured between the respective inner surface and outer surface.

Preferably the louvre-shaped inserts are cylindrical in shape.

Advantageously the flange is designed to engage with an annular ridge provided within each louvre-locating cavity, to create a clip-lock feature which holds the insert securely in position once installed.

Throughout the specification, unless the context requires otherwise, the word "comprise" or variations such as "comprises" or "comprising", will be understood to imply the inclusion of a stated integer or group of integers but not the exclusion of any other integer or group of integers. Likewise the word "preferably" or variations such as "preferred", will be understood to imply that a stated integer or group of integers is desirable but not essential to the working of the invention.

BRIEF DESCRIPTION OF THE DRAWINGS

The nature of the invention will be better understood from the following detailed description of several specific embodiments of the liquid run-off disposal system, given by way of example only, with reference to the accompanying drawings, in which:

FIG. 12*a* is a plan view of two of the culvert sections of FIG. 9*a* with an additional access culvert section connected there between;

DETAILED DESCRIPTION OF PREFERRED EMBODIMENTS

Figure 1C:
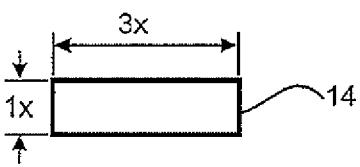
FIG. 1*c* is an enlarged view of an aperture 14 of the first embodiment shown in FIG. 1*a;*

A first embodiment of a liquid run-off disposal system 10 in accordance with the invention, as illustrated in FIGS. 1 and 2, comprises a plurality of culvert sections 12 adapted to be arranged end to end in a substantially horizontal orientation so as to form an elongate tank structure 22 below ground. Each culvert section 12 has a plurality of apertures 14 provided in the sidewalls thereof wherein, in use, when stormwater run-off is piped into the culvert sections 12 or enters through the grating 32 on top of the vertical liners, it can drain away by soaking into the surrounding soil.

Figure 2B:
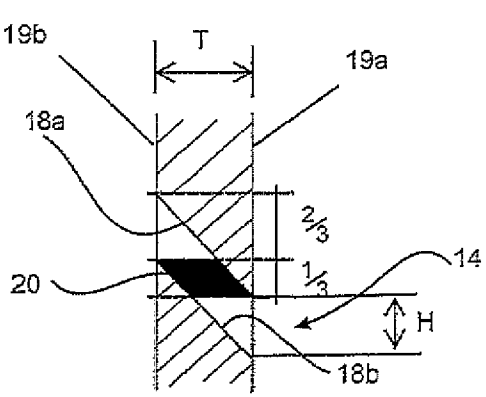
FIG. 2*b* is a detail enlargement of a cross-section of one of the louvre-shaped apertures in the sidewalls of the culvert section of FIG. 2*a;*
Figure 2A:
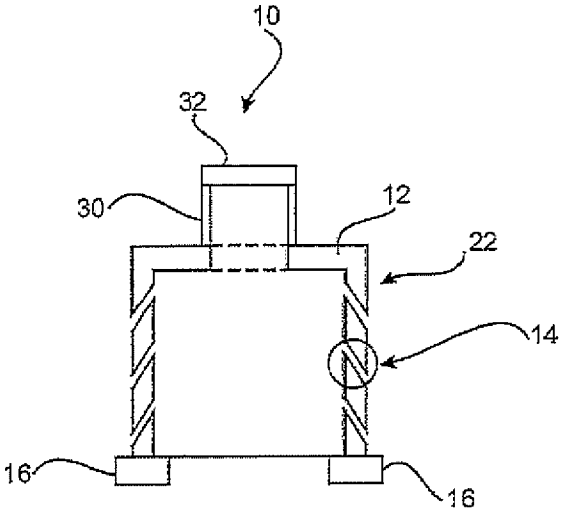
FIG. 2*a* is a cross-section view of a culvert section employed in the liquid run-off disposal system of FIG. 1*a;*

In this embodiment each culvert section 12 is of generally rectangular cross-section and is typically open at the base, as can be seen most clearly in FIG. 2*a*. Although the following description will be given primarily with reference to systems for the disposal of stormwater run-off, it will be understood that the same systems could also be used in appropriate situations for the disposal of other types of liquid run-off.

It can be seen how the culvert sections 12 thus perform a similar function to a prior art soakwell, in that stormwater run-off can drain away into the surrounding soil through the open base and the apertures 14 in the sidewalls. However, unlike a soakwell, the liquid run-off disposal system 10 is scalable in that any number of the culvert sections 12 can be joined end to end to increase the capacity of the system longitudinally rather than horizontally, the latter being far more costly when installed. This scalability also overcomes the requirement of soakwells having to be a minimum of 1800 mm apart, thereby saving space on site. Furthermore the height, length and width of the culvert sections 12 can be varied more readily to suit the application and achieve the required volume capacity.

Figure 1B:
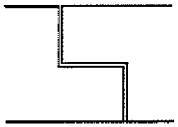
FIG. 1*b* is a detail enlargement of the interlocking arrangement of the culvert section sections in the system of FIG. 1*a;*

Preferably each culvert section 12 is of elongate construction and has interlocking edges provided at each end adapted to interlock with an adjoining culvert section 12, as shown in FIG. 1*b*. Preferably concrete footings 16 for the culvert sections 12 are provided in an excavated trench prior to installation of the liquid run-off disposal system 10 which may be subject to heavy vehicular traffic.

Advantageously the apertures 14 are louvre-shaped so as to admit the exit of water but substantially inhibit the entry of soil into the culvert section. Preferably the louvre-shaped apertures 14 are of generally rectangular shape and comprise an upper surface 18*a* and a lower surface 18*b*. Preferably the upper surface 18*a* and the lower surface 18*b* of the louvre-shaped apertures 14 are substantially parallel to each other and are angled downwards from the inside to the outside of the culvert section 12, as can be seen most clearly in FIG. 2*a*. Advantageously the upper and lower surfaces 18 are angled at such an angle, and are of a length, so as to substantially overlap in a horizontal direction, as shown by the shaded area 20 in FIG. 2*b*.

Preferably about one third of the length of the respective surfaces 18*a* and 18*b* overlap, measured in a vertical direction. The number, shape and size of the louvre-shaped apertures 14 may be varied to suit the size of the application for which the system 10 is designed.

As shown in FIG. 2*b*, in a cross-sectional view, the sidewalls of the culvert section include an outer or exterior surface 19*a* and an inner or interior surface 19*b*. Each of the sidewalls has a substantially constant thickness T defined between the surfaces 19*a*, 19*b*. In addition, each of the apertures 14 have the same height H in cross-sectional view measured between the upper surface 18*a* and the lower surface 18*b* at the surface 19*a*. Since the upper surface 18*a* and the lower surface 18*b* are substantially parallel to one another, the height H of the apertures 14 is also the same at the surface 19*b*.

In the event that the tank structure 22 were to fill with stormwater run-off and then drain via the base and sides, within a suitable time frame, a positive pressure may be formed within the hollow interior of the tank structure 22. The positive pressure of liquid entering a conventional soakwell forces the lid/cover to an unvented soakwell to dislodge and is forced upwards which immediately relieves the positive pressure but causes the immediate reverse situation within the soakwell, in that a negative pressure follows on the sidewalls which tends to draw the surrounding backfill materials into the hollow interior of the soakwell via the usual conventional apertures. This would not only cause the conventional soakwell to become clogged and ineffective, but may also result in the collapsing or sagging of surface cover in a carpark or other surrounding surfaces. However the angled arrangement and the design of the louvre-shaped apertures 14 in the case of the tank structure 22 substantially prevent such occurrences by inhibiting the ingress of soil or other backfill materials into the hollow interior of the tank structure 22 which at predetermined points has been provided with integral back pressure relief outlets.

Figure 1A:
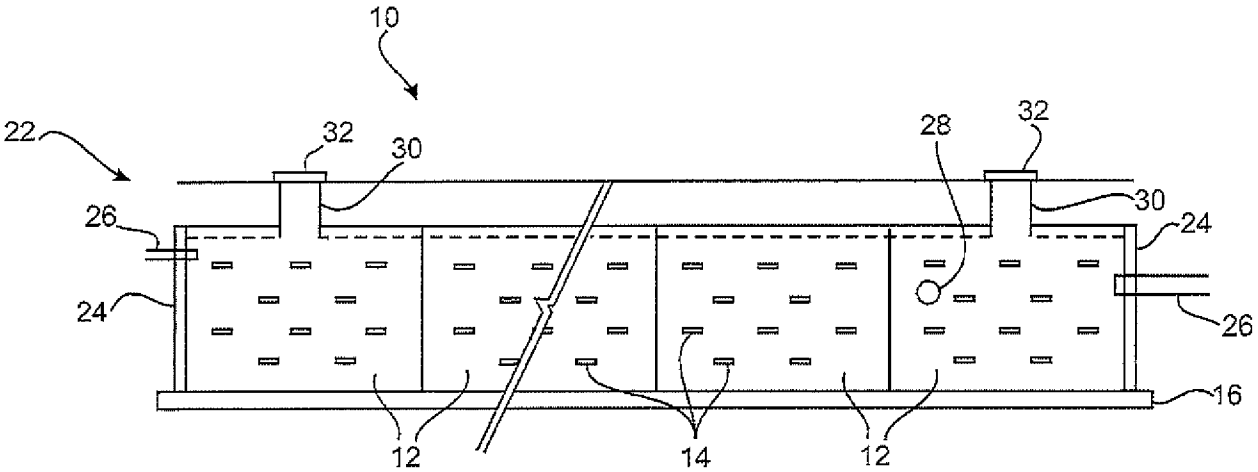
FIG. 1*a* is a side elevation of a first embodiment of a liquid run-off disposal system according to the present invention.

Preferably the liquid run-off disposal system 10 further comprises two end wall panels 24 for closing each end of the plurality of culvert sections 12, in use, so as to form an enclosed below-ground box section or tunnel section tank structure. The end wall panels 24 are typically also preferably manufactured from the same material. Preferably the end wall panels 24 will have one or more inlet holes provided therein for receiving respective inlet drainage pipes 26. The inlet drainage pipes 26 can vary in diameter and invert levels. Furthermore it is possible to have multiple connections at each end of the tank structure 22 or through the sidewalls. An alternate drainage pipe entry point 28 through a sidewall of a culvert section 12 is shown in FIG. 1*a*.

Preferably the liquid run-off disposal system further comprises one or more vertical liners 30 arranged at predetermined locations on top of the plurality of culvert sections 12 for maintenance purposes. Preferably each liner 30 is provided with a manhole cover 32 or a grating for back-pressure relief and to collect stormwater from sealed surfaces other than a building. In the illustrated embodiment the liners 30 are cylindrical but may take other shapes depending on the design and project to which the systems are applied, and are of a height required to suit the depth of the application. Larger diameter liners 30 may also be employed if required. Preferably internal step irons or a ladder is provided in accordance with OHS requirements. The liners 30 permit maintenance workers to enter the hollow interior of the culvert sections 12 for cleaning or repair work. Alternatively, or in addition thereto, an air relief grated lid may be fitted to the liner 30 or in the top or wall sections of the tank structure 22 to provide relief from back-pressure, and to collect stormwater run-off from sealed surfaces other than a building.

A second embodiment of a liquid run-off disposal system 40 in accordance with the invention is illustrated in FIGS. 3 to 6. As with the previous embodiment the system 40 comprises a plurality of sections 42 adapted to be arranged end to end in a substantially horizontal orientation so as to form an elongate tank structure 46 below ground. Each section 42 has a plurality of apertures 44 provided in the sidewalls thereof wherein, in use, when liquid run-off is piped into the sections 42 it can drain away by soaking into the surrounding soil. In this embodiment each section is in the form of a tunnel of generally upside down U-shaped cross-section and is typically open at the base, as can be seen most clearly in FIGS. 3*b*, 4*b* and 5. Each tunnel section 42 has substantially vertical sidewalls and a rounded top having a curvature dependant on the scale, particular manufacturing materials used, and the application to which the system is applied.

It can be seen how the tunnel sections 42 thus perform a similar function to a prior art soakwell, in that stormwater run-off can drain away into the surrounding soil through the open base and the apertures 44 in the sidewalls. However, unlike a soakwell, the liquid run-off disposal system 40 is scalable in that any number of the tunnel sections 12 can be joined end to end to increase the capacity of the system. Furthermore, as with the previous embodiment, the height, length and width of the tunnel sections 42 can be varied more readily to suit the application and achieve the required volume capacity. The broken line outlines in FIGS. 3 and 4 illustrate two smaller tunnel sections 42' and 42" of reduced height. The tunnel sections 42 may also be of increased or decreased diameter to vary the volume capacity of the tank structure 46.

In this embodiment the tunnel sections 42 are preferably manufactured from extruded high density polyethylene (HDPE). Vertically extending ribs 43 or other such strengthening systems provide increased strength and rigidity for the walls of the tunnel sections 42. Galvanised hexagonal bolts and nuts drilled through rib sections are employed to join the tunnel sections 42 end to end. Alternatively, the tunnel sections 42 are heat-welded together on site according to application. Stormwater pipe lines (not shown) for carrying run-off into the tank structure 46 can vary in diameter and may also vary in depth to entry. Pipes can enter through sidewalls or end walls of the tank structure 46. HDPE spigots can be factory welded if known prior to installation, or drilled/cored on site to engineer's specifications. Engineer designed end panels (not visible) made of HDPE are welded to each end of the tank structure 46 to form the end walls.

As with the first embodiment, the apertures 44 are louvre-shaped so as to admit the exit of liquid but substantially inhibit the entry of soil into the tunnel sections 42. Preferably the louvre-shaped apertures 44 are of generally rectangular shape and comprise an upper surface 48*a* and a lower surface 48*b* (not visible). Preferably the upper surface 48*a* and the lower surface 48*b* of the louvre-shaped apertures 44 are substantially parallel to each other and are angled downwards from the inside to the outside of the tunnel sections 42. Advantageously the upper and lower surfaces 48 are angled at such an angle, and are of such a length, so as to substantially overlap in a horizontal direction. Preferably between one quarter to one half of the length of the respective surfaces 48*a* and 48*b* overlap, measured in a vertical direction.

Figure 3D:
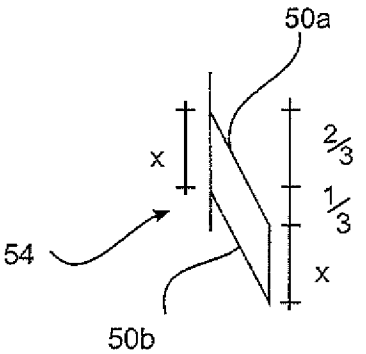
FIG. 3*d* is an enlarged side elevation of a louvre-shaped insert employed in the section of FIG. 3*a;*
Figure 3C:
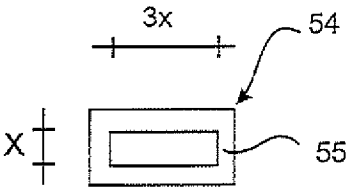
FIG. 3*c* is an enlarged plan view of a louvre-shaped insert employed in the section of FIG. 3*a;*
Figure 3A:
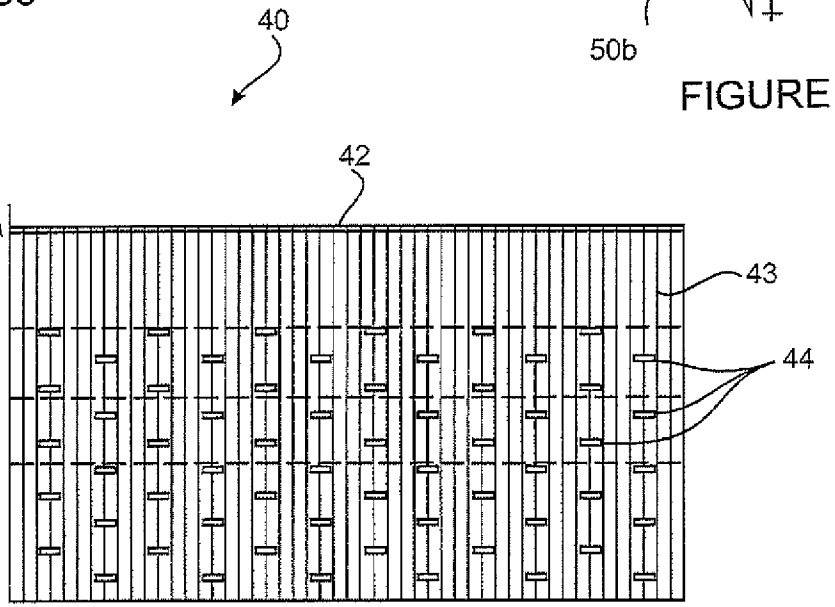
FIG. 3*a* is a side elevation of a section of a second embodiment of a liquid run-off disposal system according to the present invention.
Figure 3B:
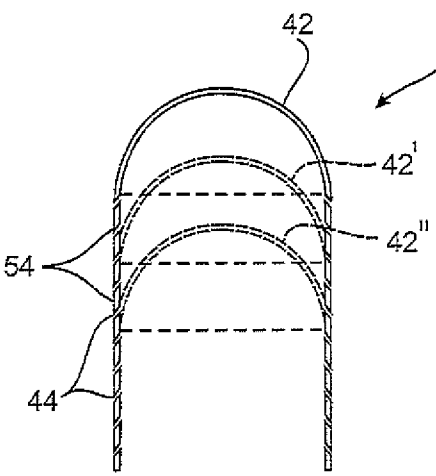
FIG. 3*b* is an end elevation of the section of FIG. 3*a;*
Figures 4A, 4B:
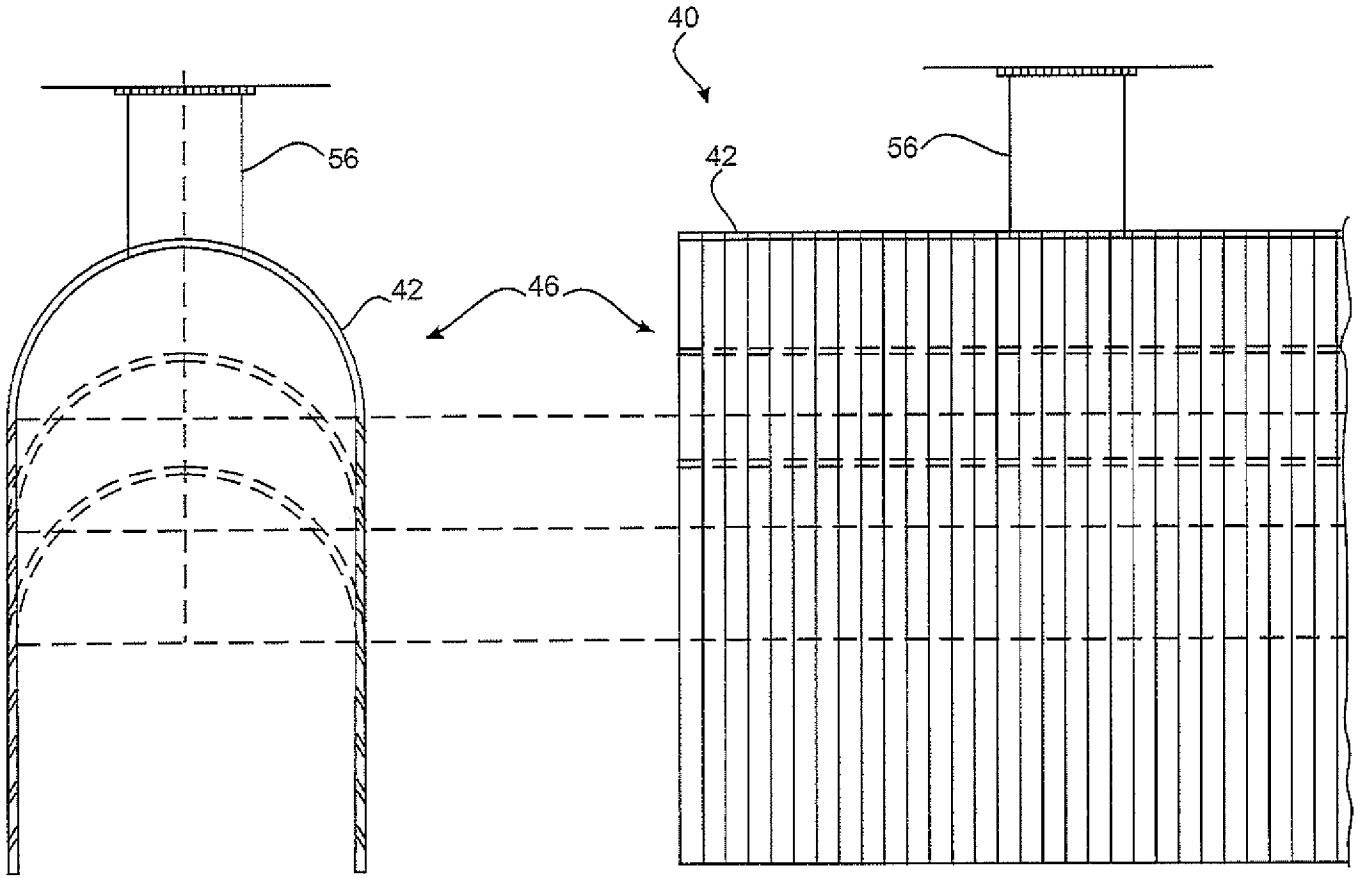
FIG. 4*a* is a side elevation of a section of the liquid run-off disposal system of FIG. 3*a* with an access chamber.
FIG. 4*b* is an end elevation of the section of FIG. 4*a;*

The number, shape and size of the louvre-shaped apertures 44 may be varied to suit the size of the application for which the system 40 is designed. Each louvre-shaped aperture 44 is preferably dimensioned with the width being twice the depth ie 2× wide to 1× deep. Typically each louvre-shaped aperture 44 is of dimension about 100 mm wide and 50 mm deep. The upper and lower surfaces 48 may be formed on upper and lower walls 50, which together with sidewalls 52, form a louvre-shaped insert 54, which may be mass-produced from injection moulded HDPE as a separate component. The louvre-shaped inserts 54 have a flange 55 (see FIG. 3*c*) which is fused or welded to the inside of the tunnel sections 42 in pre-cut apertures, as shown in FIG. 3*b*.

Preferably the liquid run-off disposal system 40 further comprises one or more vertical liners or access chambers 56 arranged at predetermined locations on top of the tunnel sections 42 for maintenance purposes, as shown in FIG. 4. The access chamber 56 is fixed to the top of a tunnel section 42, which has a suitable opening cut into the top to provide human access into the hollow interior of the tank structure 46. Human access means that improved maintenance can be provided; prior art culvert systems can only do maintenance by pressure cleaners and jetting water but not by human access.

Preferably each access chamber 56 is provided with a manhole cover or a grating for back-pressure relief and to collect stormwater run-off from sealed surfaces other than a building. In the illustrated embodiment the vertical liners 56 are cylindrical but may take other shapes depending on the design and project to which the systems are applied, and are of a height required to suit the depth of the application. The access chambers 56 provide maintenance workers access the hollow interior of the tunnel sections 42 for cleaning or repair work. Alternatively, the manhole, grating or access chambers may be the normal drainage soakwells or gully pits in the car park areas of a development with the stormwater cylindrical tanks system installed between these manhole/access chambers.

Figure 5C:
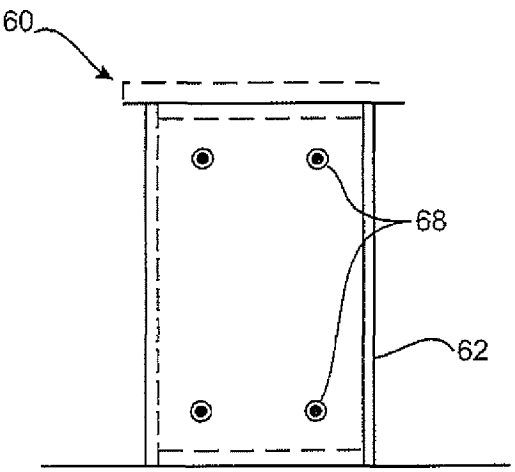
FIG. 5*c* is a plan view of the section of FIG. 5*a;*
Figure 5B:
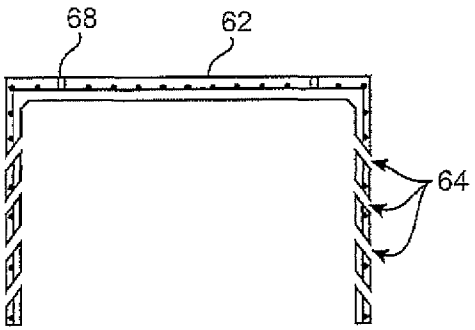
FIG. 5*b* is an end elevation of the section of FIG. 5*a;*
Figure 5E:
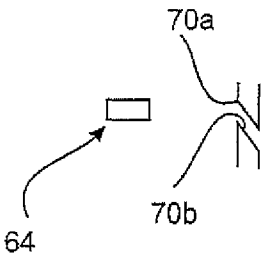
FIG. 5*e* is a detail plan view and section view of one of the louvre-shaped apertures in the sidewall of the section of FIG. 5*a;*
Figure 5D:
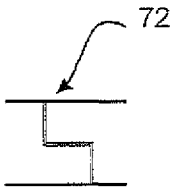
FIG. 5*d* is a detail view of an interlocking arrangement on the section of FIG. 5*a;*
Figure 5A:
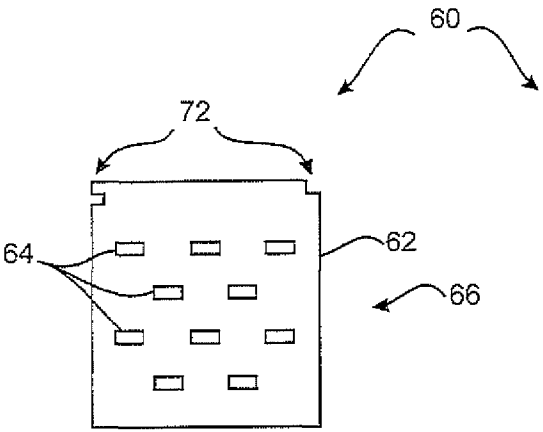
FIG. 5*a* is a side elevation of a section of a third embodiment of a liquid run-off disposal system according to the present invention.
Figures 6A, 6B, 6C:
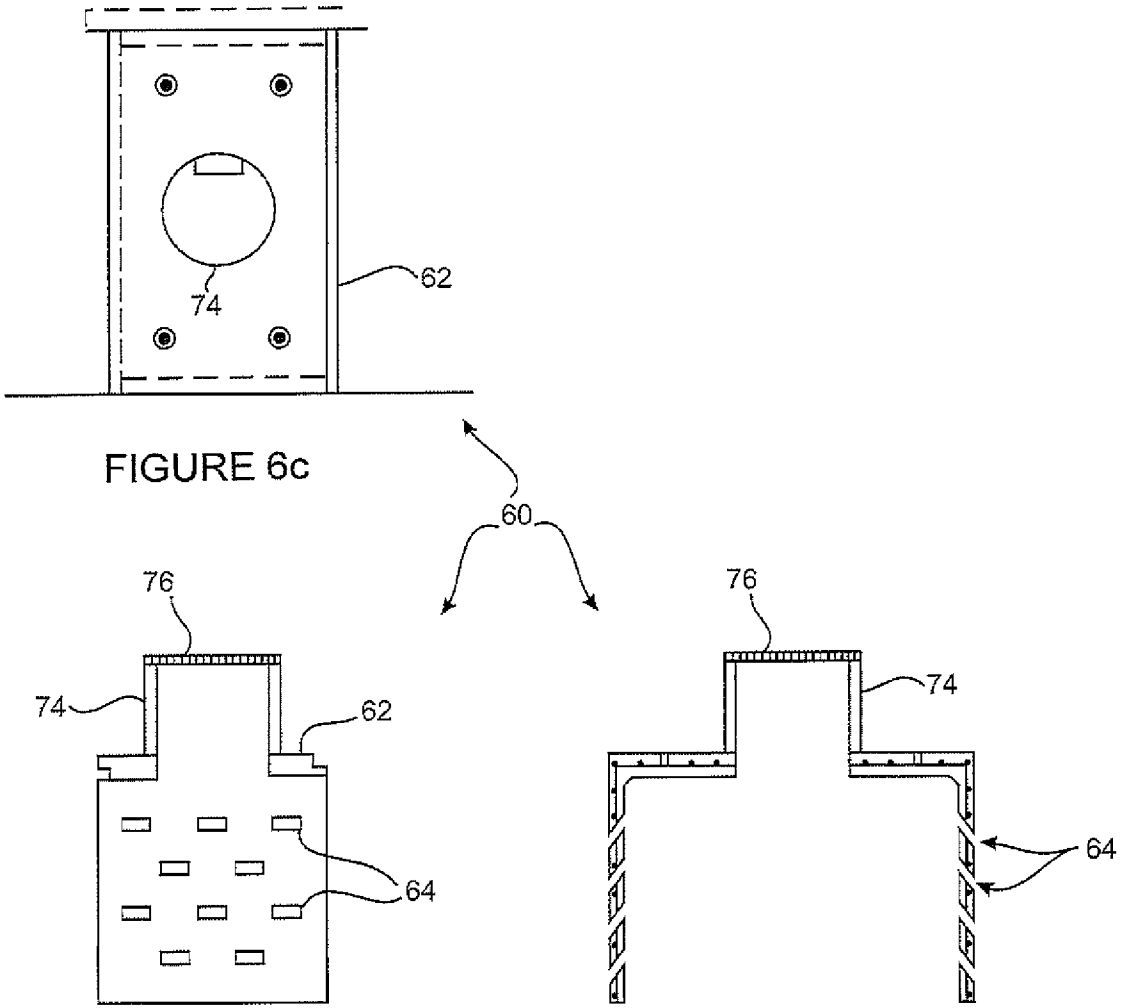
FIG. 6*a* is a side elevation of a section of the liquid run-off disposal system of FIG. 5*a* with an access chamber.
FIG. 6*b* is an end elevation of the section of FIG. 6*a;*
FIG. 6*c* is a plan view of the section of FIG. 6*a;*

A third embodiment of a liquid run-off disposal system 60 in accordance with the invention is illustrated in FIGS. 5 and 6. As with the previous embodiments the system 60 comprises a plurality of sections 62 adapted to be arranged end to end in a substantially horizontal orientation so as to form an elongate tank structure 66 below ground. Each section 62 has a plurality of apertures 64 provided in the sidewalls thereof wherein, in use, when run-off is piped into the sections 62 it can drain away by soaking into the surrounding soil. In this embodiment each section 62 is in the form of a box-shaped culvert and is typically open at the base, as can be seen most clearly in FIGS. 5*b* and 6*b*.

It can be seen how the culvert sections 62 thus function in a similar manner to the culvert sections 12 of the first embodiment, and therefore their operation will not be described again in detail. Each culvert section 62 of this embodiment has a plurality of rectangular louvre-shaped apertures 64 formed in the sidewalls thereof in a uniform rectangular array, as can be seen most clearly in FIG. 5*a*. A plurality of lifting lugs 68 are provided on the top of the culvert section 62 to permit it to be easily lifted and manoeuvred into position with a crane. Each culvert section 62 of this embodiment has an internal width of approximately 1.9 m and an internal height of approximately 1.0 m.

As with the previous embodiments, the apertures 64 are louvre-shaped so as to admit the exit of liquid but substantially inhibit the entry of soil into the culvert sections 62. Preferably the louvre-shaped apertures 64 are of generally rectangular shape and comprise an upper surface 70*a* and a lower surface 70*b* (see detail in FIG. 5*e*). The design and function of the louvre-shaped apertures 64 is similar to the design and function of the louvre-shaped apertures 14 of the first embodiment, and will not be described again here.

Preferably each culvert section 62 is of rectangular construction and has interlocking edges 72 provided at each end adapted to interlock with an adjoining culvert section 62, as shown in FIG. 5*d*. Preferably the liquid run-off disposal system further comprises one or more vertical liners 74 arranged at predetermined locations on top of the culvert sections 62, as shown in FIG. 6. Preferably each liner 74 is provided with a manhole cover 76 or a grating for back-pressure relief and to collect stormwater run-off. Once again, in this embodiment the liners 74 are cylindrical but may take other shapes depending on the design and project to which the systems are applied, and are of a height required to suit the depth of the application.

Figure 7:
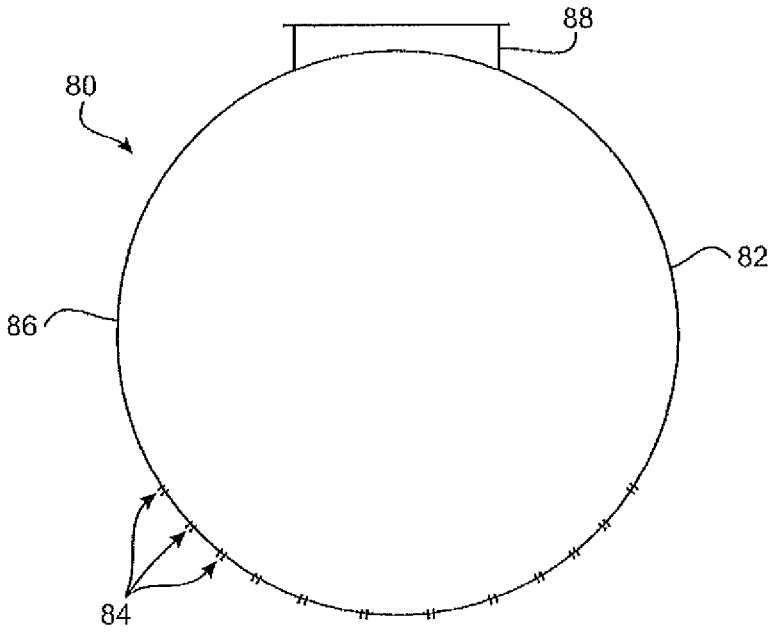
FIG. 7 is an end elevation of a fourth embodiment of a liquid run-off disposal system according to the present invention.

A fourth embodiment of a liquid run-off disposal system 80 in accordance with the invention is illustrated in FIG. 7. As with the previous embodiments the system 80 comprises a plurality of culvert sections 82 adapted to be arranged end to end in a substantially horizontal orientation so as to form an elongate tank structure 86 below ground. Each culvert section 82 has a plurality of apertures 84 provided in the sidewalls thereof wherein, in use, when run-off is piped into the sections 82 it can drain away by soaking into the surrounding soil. Preferably the plurality of apertures 84 are provided in the sidewalls at a height lower than the centreline of the culvert section. In this embodiment each section 82 is in the form of a cylindrical culvert and is typically of circular cross-section.

The apertures 84 of this embodiment are typically cylindrical shaped apertures provided in the bottom section of the cylindrical culvert. Liquid run-off flowing into the system 80 can drain into the soil through apertures 84. Preferably the liquid run-off disposal system 80 further comprises one or more vertical liners 88 arranged at predetermined locations on top of the culvert sections 82, as shown in FIG. 7. The liners 88 are similar to that previously described and will not be described again here.

Figure 8A:
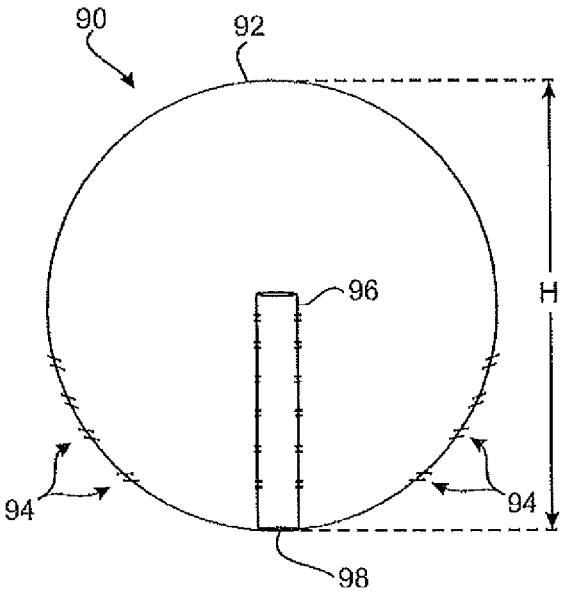
FIG. 8*a* is an end elevation of a fifth embodiment of a liquid run-off disposal system according to the present invention.
Figure 8B:
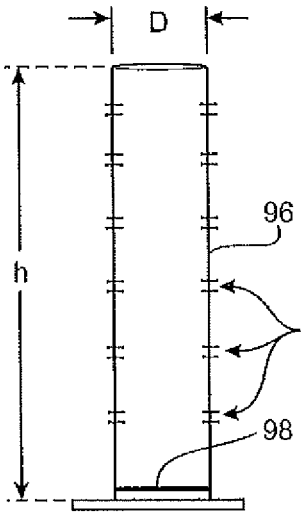
FIG. 8*b* is an enlarged view of part of the system of FIG. 8*a;*
Figure 9B:
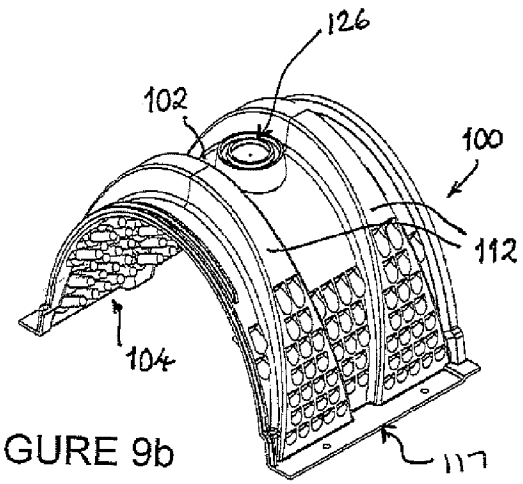
FIG. 9*b* is a perspective view of the culvert section of FIG. 9*a;*
Figure 9D:
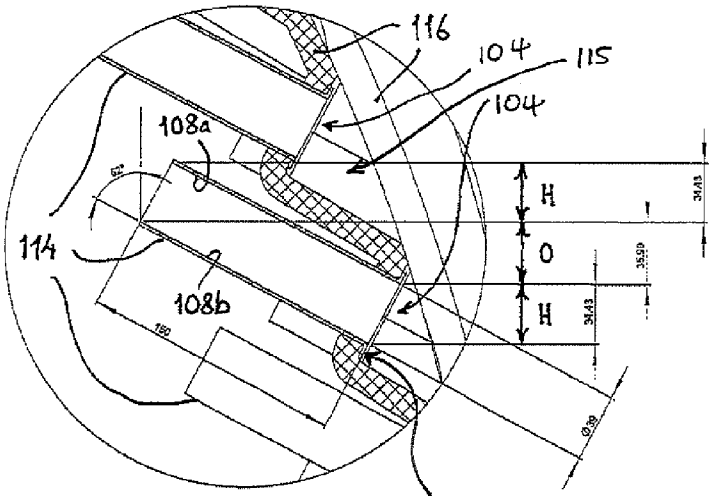
FIG. 9*d* is an enlargement of detail 'D' in FIG. 9*c;*
Figure 9A:
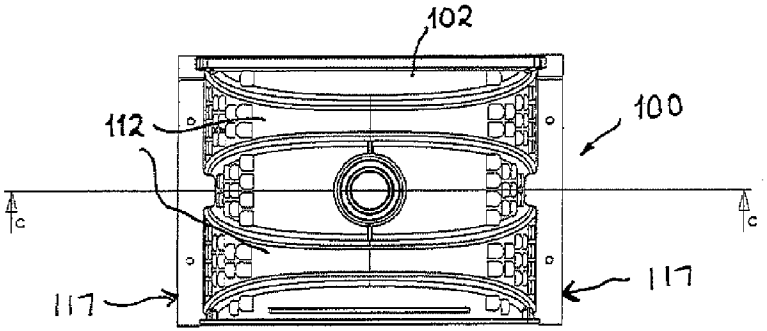
FIG. 9*a* is a plan view of a culvert section of a sixth embodiment of a liquid run-off disposal system according to the present invention.
Figure 9C:
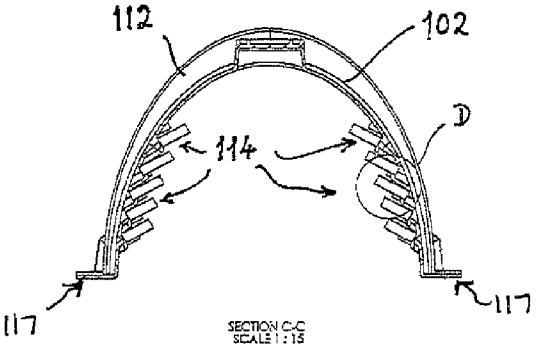
FIG. 9*c* is a section view along the line C-C through the culvert section of FIG. 9*a;*

A fifth embodiment of a liquid run-off disposal system 90 in accordance with the invention is illustrated in FIG. 8. Once again the system 90 comprises a plurality of culvert sections 92 adapted to be arranged end to end in a substantially horizontal orientation so as to form an elongate tank structure below ground. Each culvert section 92 has a plurality of apertures 94 provided in the sidewalls thereof wherein, in use, when run-off is piped into the sections 92 it can drain away by soaking into the surrounding soil. In this embodiment each section 92 is in the form of a cylindrical culvert and is typically of circular cross-section. The apertures 94 are preferably arranged at spaced intervals along the lower half of the sidewalls of each section 92.

As with the previous embodiments, the apertures 94 are preferably louvre-shaped so as to admit the exit of liquid but substantially inhibit the entry of soil into the culvert sections 92. The design and function of the louvre-shaped apertures 94 is similar to the design and function of the louvre-shaped apertures 14 of the first embodiment, and will not be described again here.

Preferably this embodiment of the liquid disposal system 90 further comprises one or more vertically oriented elongate drain pipes 96 which are mounted inside each culvert section 92. Each drain pipe 96 is of hollow cylindrical cross-section and has an opening at the bottom end which connects to a drain hole provided in the floor of the culvert section 92. Preferably the opening at the bottom end of the drain pipe is provided with a one-way valve 98 for inhibiting the reverse flow of liquid through the drain hole back into the culvert section 92, for example, in soil subject to a rising water table. The drain pipe 96 is provided with a series of apertures 99 at spaced intervals about its circumference and along its length. The apertures 99 allow any liquid which accumulates in the lower half or bottom of the cylindrical culvert sections 92 to drain away in a controlled manner through the drain hole in the floor of the culvert. In use, any liquid which accumulates in the lower half of the culvert section is allowed to drain away in a controlled manner through the louvre-shaped apertures in the culvert section, which may be the normal drainage soakwells or gully pits in the car park areas of a development with the stormwater cylindrical tanks system installed between these manhole/access chambers.

A sixth embodiment of a liquid run-off disposal system 100 in accordance with the invention is illustrated in FIGS. 9 and 10. Once again the system 100 comprises a plurality of culvert sections 102 adapted to be arranged end to end in a substantially horizontal orientation so as to form an elongate tank structure below ground. Each culvert section 102 has a plurality of apertures 104 provided in the sidewalls thereof wherein, in use, when run-off is piped into the sections 102 it can drain away by soaking into the surrounding soil through the apertures 104. In this embodiment each section 102 is in the form of an arch-shaped culvert and is typically open at the base, as can be seen most clearly in FIGS. 9*b* and 9*c*.

It can be seen how the culvert sections 102 thus function in a similar manner to the culvert sections 12 of the first embodiment, and therefore their operation will not be described again in detail. Each culvert section 102 of this embodiment has a plurality of circular louvre-shaped apertures 104 formed in sidewalls 116 thereof in a uniform array, as can be seen most clearly in FIG. 10*d*. Each culvert section 102 of this embodiment typically has a parabolic or semi-elliptic cross-sectional shape, as can be seen most clearly in FIGS. 9*c* and 10*b*, and has an internal width of approximately 1.3 m and an internal height of approximately 1.0 m, and is about 1.2 m in length. The actual dimensions will vary depending on the size of the culvert section. The sidewalls 116 are of substantially constant thickness.

Preferably each culvert section 102 is formed with one or more reinforcing ribs 112, which extend over the whole external circumference of the section. In this embodiment two reinforcing ribs 112 are provided in each section.

Each reinforcing rib is also of parabolic or semi-elliptic cross-sectional shape, but has a larger internal diameter than the sidewalls 116. Each reinforcing rib 112 is of substantially rectangular cross-section when viewed transversely of the rib, as can be seen most clearly in FIG. 4*c*. The reinforcing ribs 112 are also formed with louvre-shaped apertures 104. As can be seen most clearly in FIGS. 3*b*, 3*c*, 4*b*, 4*c*, 4*d* and 5, the reinforcing ribs 112 have an outer wall 113 of increased height relative to the apex of the parabolic sidewalls 116. The reinforcing ribs 112 are also wider near the base of the section than at the apex of the culvert section 102. These relative dimensions are shown in FIG. 5. The size and shape of the ribs 112 (defined by dimensions D, E, F, G) is determined relative to the basic arch geometry of the sidewall 116 of the section (defined by dimensions A, B, C).

The basic proportions of the reinforcing ribs 112 relative to the basic arch geometry are summarised in Tables 1 and 2 below:

TABLE 1

Basic rib proportions

| | | | | |
|---|---|---|---|---|
| DIMENSION | D = | APPROXIMATELY | 17% | DIMENSION A |
| DIMENSION | E = | APPROXIMATELY | 11% | DIMENSION C |
| DIMENSION | F = | APPROXIMATELY | 4% | DIMENSION B |
| DIMENSION | G = | APPROXIMATELY | 40% | DIMENSION C |

As can be seen from FIG. 5 and Table 1, at the apex the height of the outer wall 113 of each rib 112, marked as dimension D in FIG. 5, is typically between 15% to 19% higher than the height of the parabolic sidewalls 116 (in this embodiment approximately 17% higher), marked as dimension A in FIG. 5. On the other hand, at the apex the width of the outer wall 113, marked as dimension E in FIG. 5, is typically between 9% and 13% of the total length of the section (in this embodiment approximately 11%), marked as dimension C in FIG. 5. However, at the base the width of the outer wall 113, marked as dimension G in FIG. 5, is typically between 35% to 45% of the total length of the section (in this embodiment approximately 40%), marked as dimension C in FIG. 5.

TABLE 2

Detailed analysis of different sized sections

| | | 1.0 $m^3$/m arch verified with FEA | 2.0 $m^3$/m arch verified with FEA | 4.5 $m^3$/m arch verified with FEA |
|---|---|---|---|---|
| A | internal arch height | 940 | 1295 | 1930 |
| B | internal arch width | 1340 | 1860 | 5560 |

TABLE 2-continued

| Detailed analysis of different sized sections | | | | | | | | | | |
|---|---|---|---|---|---|---|---|---|---|---|
| | | 1.0 $m^3$/m arch verified with FEA | | | 2.0 $m^3$/m arch verified with FEA | | | 4.5 $m^3$/m arch verified with FEA | | |
| C | effective arch length | 1115 | | | 1115 | | | 1915 | | |
| D | rib height (top) | 150 | 16% | A | 225 | 17% | A | 335 | 17% | A |
| E | rib width (top | 125 | 11% | C | 125 | 11% | C | 210 | 11% | C |
| F | rib height (base) | 50 | 4% | B | 85 | 5% | B | 150 | 3% | B |
| G | rib width (base) | 460 | 41% | C | 450 | 40% | C | 750 | 39% | C |

Table 2 gives the proposed dimensions of the reinforcing ribs 112 on three different size culvert sections 112, namely, one with a 1.0 $m^3$/m arch, one with a 2.0 $m^3$/m arch, and one with a 4.5 $m^3$/m arch to demonstrate the proportionality of dimensions. The mechanical integrity of the designs has been verified by Finite Element Analysis (FEA), which is done via computer modelling software to prove the structural integrity of structural designs for certification of load-bearing capacities.

Figure 11:
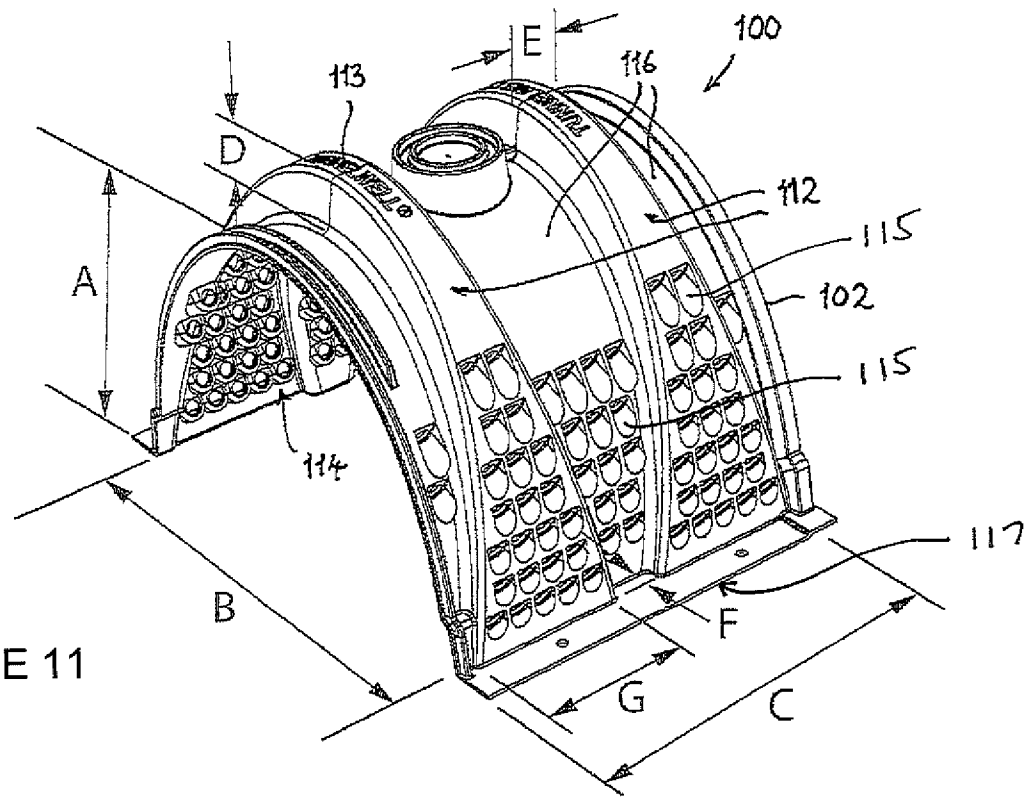
FIG. 11 is a top perspective view of the culvert section of FIG. 9*a;*
Figure 12A:
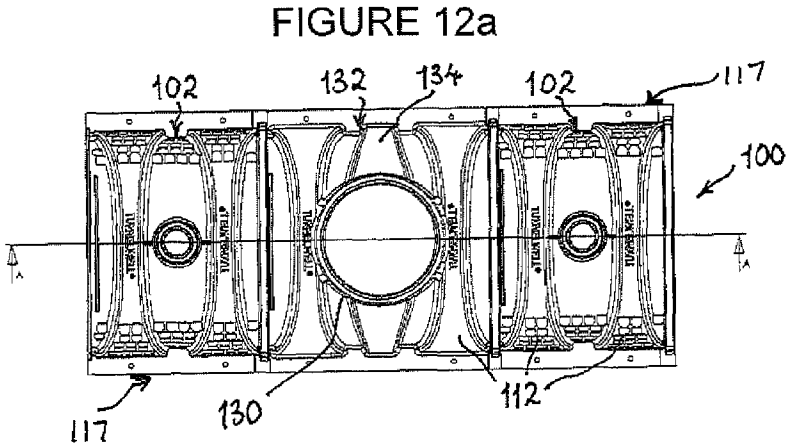
Figure 12B:
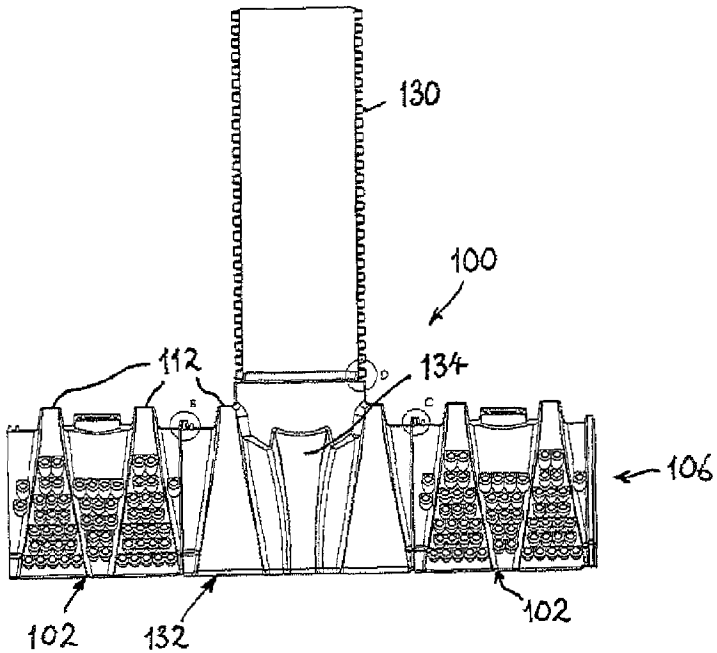
FIG. 12*b* is a section view along the line A-A through the culvert sections of FIG. 12*a;*
Figure 12C:
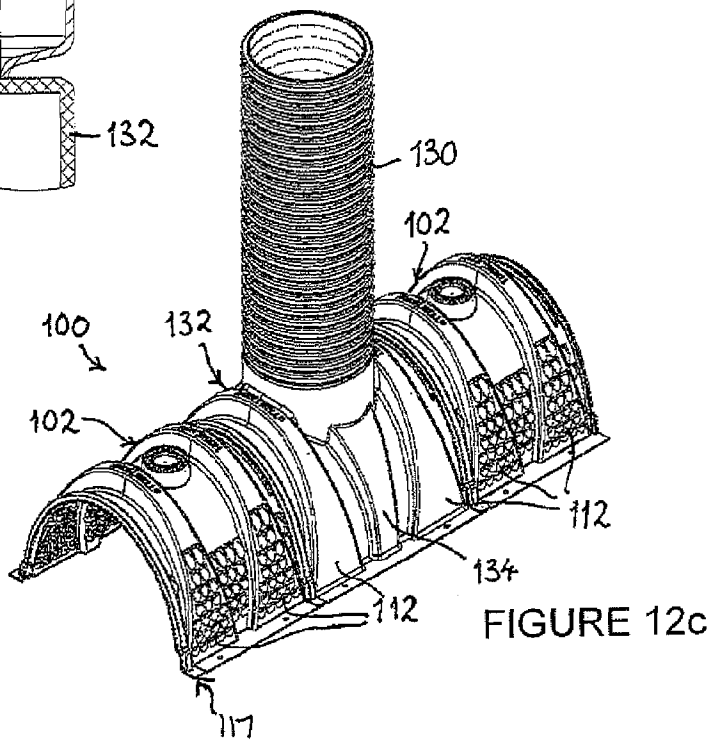
FIG. 12*c* is a perspective view of the culvert sections of FIG. 12*a*.
Figure 12D:
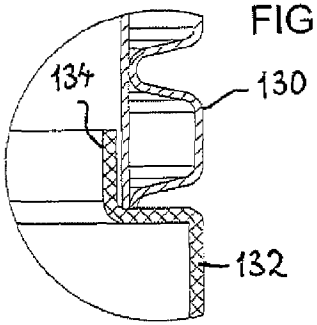
FIG. 12*d* is an enlargement of detail 'D' in FIG. 12*b.*

The parabolic or semi-elliptic arch-shaped design substantially increases the strength of the section 102 so that it can withstand heavy vehicular traffic and earth loadings. Each section 102 is also preferably provided with a flared base, formed by lip 117 extending along the respective longitudinal edges of the culvert section 102, as can be seen most clearly in FIG. 11. The lip 117 also increases the stiffness and strength of the section.

The primary function of the reinforcing ribs 112 in the sidewall of the arch is to increase the out-of-plane stiffness of the section. For most buried arch structures, out-of-plane buckling generally governs the design. Given that the out-of-plane stiffness is proportional to the buckling capacity, the increase in stiffness afforded by the ribs 112 increases the buckling capacity of the section.

The reinforcing rib design has been able to demonstrate a load bearing capacity well within the maximum required load pressure requirements for products being certified for a Load capacity for Allowable Stress MPa figures required.

As with the previous embodiments, the apertures 104 are louvre-shaped so as to admit the exit of liquid but substantially inhibit the entry of soil into the culvert sections 102. Preferably the louvre-shaped apertures 104 are of cylindrical shape and comprise an upper surface 108*a* and a lower surface 108*b* (see detail in FIG. 9*d*). The upper and lower surfaces 108 are substantially parallel to each other and are angled downwards from the inside to the outside of the culvert section 102. Advantageously the upper and lower surfaces 18 are angled at such an angle, and are of a length, so as to substantially overlap in a horizontal direction, marked "O" in FIG. 9*d*. In this embodiment about one half of the length of the respective surfaces 108*a* and 108*b* overlap, measured in a vertical direction, i.e. H≈O.

Advantageously the louvre-shaped apertures 104 are provided in the form of louvre-shaped inserts 114, similar to the inserts 54 of the second embodiment, and may be mass-produced from injection moulded plastics material as a separate component. However the louvre-shaped inserts 114 of this embodiment are designed to be received in matching louvre-locating cavities 115. Each louvre-locating cavity 115 is formed with a bore 122, through which the louvre-shaped insert 114 is inserted from the outside of the culvert section so that it passes through the sidewall 116, protruding inwardly and extending upwardly from the inner surface of the sidewall 116 into the inside of the culvert section. Each louvre-shaped insert 114 is of elongate configuration, having a substantially perpendicular face at each end; an outer face at an outer end that is open, in use, to the outside of the culvert section and which sits more or less flush with an outer surface of the sidewall 116, and an inner face at an inner end that is open, in use, to the inside of the culvert section.

The louvre-shaped inserts 114 have a flange 118 on the outer face which may be fused or welded into the louvre-locating cavities 115 provided in the sidewalls 116 and ribs 112 of the culvert sections 102. Alternatively, the flange 118 is designed to engage with an annular ridge provided within each louvre-locating cavity 115, to create a clip-lock feature which holds the insert 114 securely in position once installed. The angle at which a louvre-shaped insert 114 extends upwardly from the inner surface of the sidewall 116 into the inside of the culvert section is determined by the angle that the sidewall 116 forms within the louvre-locating cavity 115. In the illustrated embodiment, the part of the sidewall 116, against which the flange 118 of the louvre-shaped insert 114 rests, is angled at about 30° to the vertical, which means the angle at which the louvre-shaped insert 114 extends into the culvert section is about 60° to the vertical. This angle of inclination remains substantially constant for all of the louvre-shaped inserts 114, as can be seen most clearly in FIG. 9*c*.

Each louvre-locating cavity 115 is in the form of a recessed portion of the sidewall 116, in which a part of the sidewall is shaped so as to have an angled profile in cross-section. The part of the sidewall 116 within the louvre-locating cavity 115, against which the flange 118 of the louvre-shaped insert 114 rests, turns at substantially a right-angle and returns back outwardly to the main outer surface of the sidewall 116. The result is a series of scallop-shaped louvre-locating cavities 115, of increasing length as one moves up the sidewalls 116, as can be seen most clearly in FIG. 5. In the illustrated embodiment, those parts of the sidewall 116 that form the louvre-locating cavity 115, have a zig-zag profile in cross-section, as can be seen most clearly in FIG. 9*d*.

One of the advantages of the louvre-locating cavities 115 is that the outside face of the louvre-shaped inserts 114 is facing downwards, and is partially shielded within its louvre-locating cavity 115. This configuration, combined with the natural repose angle of the sand or soil adjacent to the culvert section, and the downwards orientation of the louvre-shaped inserts 114, means that very little, if any, sand or soil will travel upwards into the louvre-shaped inserts 114 and into the inside of the culvert section.

The most important advantage of the louvre-locating cavities 115 is that they provide additional strength to the culvert sections. Surprisingly, it has been demonstrated by experiment that the out-of-plane stiffness of the section is substantially increased due to the incorporation in the sidewalls 16 of the angled profile of those parts of the sidewall 116 that form the louvre-locating cavity 115. For example, with the access tunnel section 134 illustrated in FIG. 6 there were no louvre-locating cavities 115 provided in the sidewalls. When this section was buried during a test, the soils backfilled and compacted, the sidewalls bowed inwards and the whole section threatened to collapse. By contrast, the adjoining sections, which incorporated the louvre-locating cavities 115, showed almost zero deformation. The incorporation of the louvre-locating cavities 115, with their angled profile, thus significantly increases the strength of the sidewalls 116 of the culvert section 102.

Preferably each culvert section 102 has interlocking edges 120 provided at each end and adapted to interlock with an adjoining culvert section 102, as shown in FIGS. 10*b*, 10*c*, 10*e* and 10*f*. A male edge 120*a* is proved at one end, and is designed to interlock with a female edge 12*b* provided at the other end of each culvert section 102.

Figure 10A:
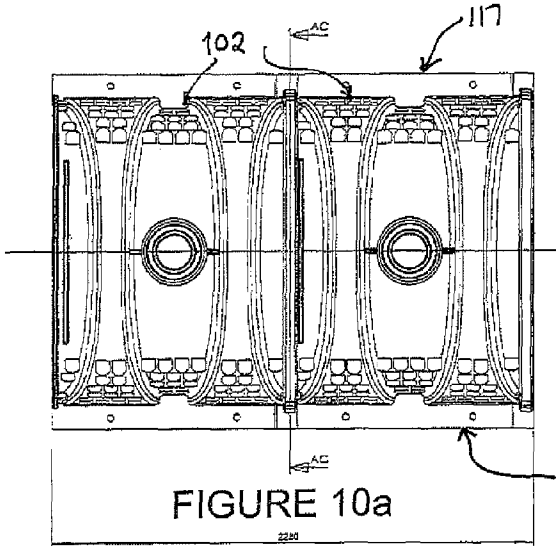
FIG. 10*a* is a plan view of two of the culvert sections of FIG. 9*a* joined end-to-end.
Figure 10B:
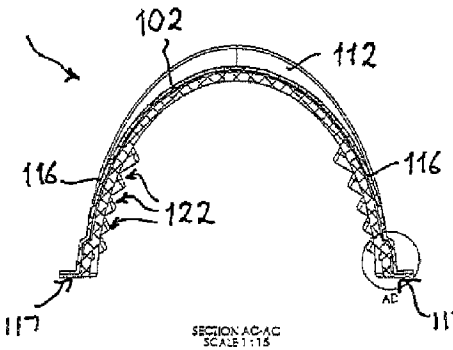
FIG. 10*b* is a section view along the line AC-AC through the join between the two culvert sections of FIG. 10*a;*
Figure 10C:
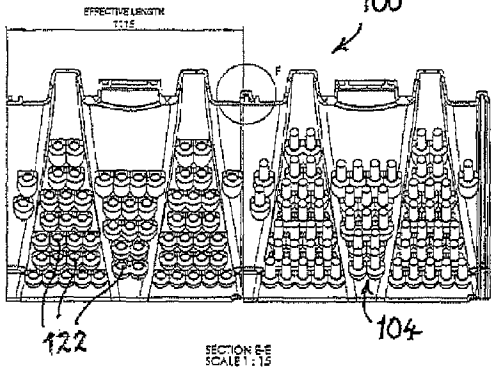
FIG. 10*c* is a section view along the line E-E through the two culvert sections of FIG. 10*a;*
Figure 10F:
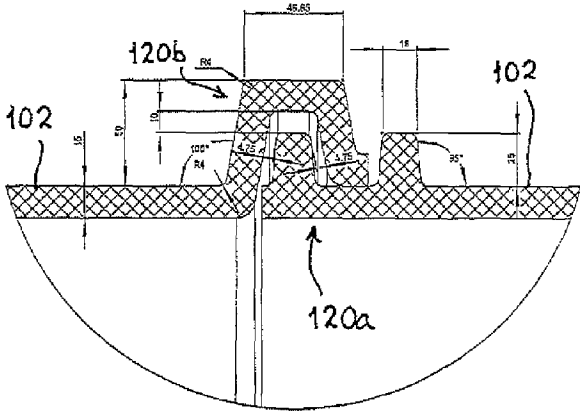
FIG. 10*f* is an enlargement of detail 'F' in FIG. 10*c,*
Figure 10E:
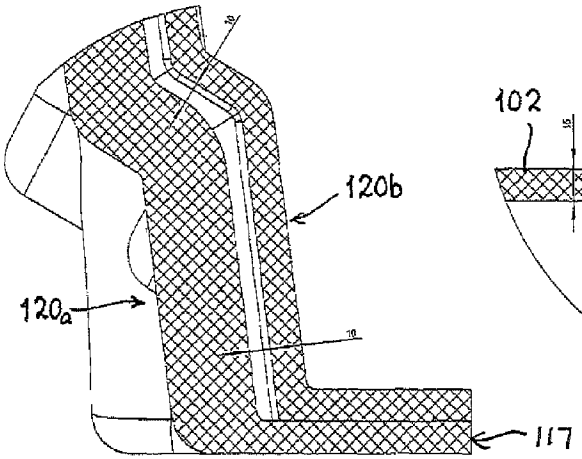
FIG. 10*e* is an enlargement of detail 'AD' in FIG. 10*b;*
Figure 10D:
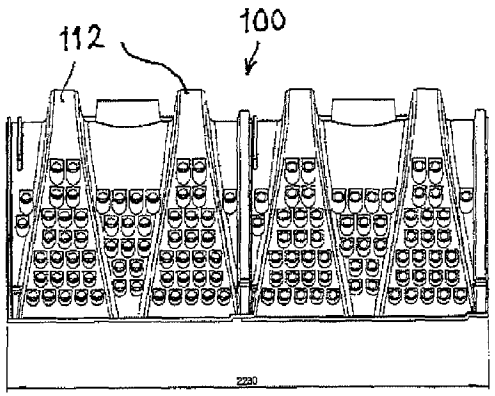
FIG. 10*d* is a side elevation of the two culvert sections of FIG. 10*a;*

Stormwater or effluent pipe lines (not shown) for carrying run-off into the tank structure 106 can vary in diameter and may also vary in depth to entry. Pipes can enter through the top, sidewalls or end walls of the tank structure 106. As can be seen most clearly in FIG. 9*b*, each culvert or tunnel section 102 is provided with a protruding double ring, integral, pipe insert spigot 126, for receiving 150 mm & 225 mm diameter pipes. Smaller diameter pipes may be employed by using bushes. PE spigots can be factory welded if known prior to installation, or drilled/cored on site to engineer's specifications. Engineer designed end panels (not visible) made of PE are welded or attached (they clip-over like the arch end sections as shown in FIG. 10*f*) to each end of the tank structure 106 to form the end walls. Effluent pipes may also enter the culvert section through the end panels.

Preferably the liquid run-off disposal system 100 further comprises one or more vertical liners or access chambers 130 arranged at predetermined locations on top of the tunnel or culvert sections 102 for maintenance purposes, as shown in FIG. 12. The access chamber 130 is fixed to the top of a special access tunnel section 132, which has a suitable opening cut into the top to provide human access into the hollow interior of the tank structure 106. Human access means that improved maintenance can be provided; prior art culvert systems can only do maintenance by pressure cleaners and jetting water but not by human access.

The access tunnel section 132 is provided with an additional reinforcing rib 134, located centrally of the section to provide additional strength and rigidity in the sidewalls to support the access chamber 130. The access chamber 130 of this embodiment is shown with an elongated, corrugated, cylindrical sidewall that is attached at a bottom end to a spigot 134 provided on top of the access tunnel 132 (see FIG. 12*d*).

The culvert sections 102 are preferably manufactured from rotomoulded Linear Low Density Polyethylene (LLDPE) material and typically have a wall thickness of 11 mm for heavy loads and a reducing wall thickness of 5 mm for light loads. The louvre-shaped inserts 114 are typically manufactured from injection-moulded polyethylene, have a wall thickness of 2 mm and are about 150 mm in length. Alternatively the whole culvert section 102, including the louvre-shaped apertures 104, may be manufactured as one piece using an injection-moulded plastics material. In that case the louvre-shaped apertures 104 may be of reduced dimensions. Wall thicknesses will vary depending on the size and the end-user application.

It will be understood that each of the above-described embodiments the culvert sections can be manufactured from any suitably rigid and strong material, including suitable plastics products such as HDPE, polypropylene, polyethylene and thermoplastics. Other suitable materials include various synthetic compounds, polymers, petrochemical derivatives, and fibreglass compounds.

Now that several embodiments of the liquid run-off disposal system have been described in detail, it will be apparent that the described embodiments provide a number of advantages over the prior art, including the following:

(i) Each of the embodiments is fully scalable in that the number of sections as well as the shape, height, length and width of the sections can be varied to suit the application.

(ii) The scalability of the system can provide for greater land use by developers and local councils as it can do away with age old system designs such as compensating basins in subdivisions.

(iii) The louvre-shaped apertures, in particular their downward angle together with the overlapping sides, obviate the need for the use of geotechnical cloth to prevent the ingress of most soil types.

(iv) The culvert sections are simple and easy to install, and can be installed more quickly and inexpensively, compared to prior art soakwells.

(v) The excavated material from the installation of the present system is easily quantifiable for reuse by earthmovers.

(vi) The sections may be readily mass-produced from various materials, thus reducing manufacturing costs.

(vii) The sections are condensed into less physical space on site than conventional soakwells, and therefore provide a much greater storage capacity over a similar area to conventional soakwells which must be placed 1800 mm apart to have effective soakage capabilities.

It will be readily apparent to persons skilled in the relevant arts that various modifications and improvements may be made to the foregoing embodiments, in addition to those already described, without departing from the basic inventive concepts of the present invention. For example, although in the illustrated embodiments the sections generally only have apertures provided on selected portions of the sidewalls, it will be understood that the number, distribution and spacing of the apertures may be varied considerably from that shown. Therefore, it will be appreciated that the scope of the invention is not limited to the specific embodiments described.

The invention claimed is:

1. A liquid run-off disposal system comprising:

an elongate tank structure having one or more sections adapted to be arranged end to end in a substantially horizontal orientation below ground, each section of the tank structure taking the form of a culvert section having first and second sidewalls, in cross-sectional view the first and second sidewalls each include an inner surface and outer surface;

the first and second sidewalls each include a plurality of louvre-shaped inserts received in louvre-locating cavities provided therein, each louvre-locating cavity being in the form of a recessed portion of the sidewall, in which a part of the sidewall is shaped so as to have an angled profile in cross-section, wherein the angled profile of the louvre-locating cavities substantially increases the strength of the sidewall;

in cross-sectional view each louvre-shaped insert includes an upper surface and a lower surface which are substantially parallel to each other and are angled upwards from the outer surface to the inner surface, and for each insert the distance between the upper surface and the lower surface at the outer surface is the same so that each of the inserts have substantially the same height at the outer surface; and, the upper and lower surfaces are angled at such an angle and are of a length so as to substantially overlap in a horizontal direction so as to admit the exit of water but substantially inhibit the entry of soil wherein, in use, when liquid run-off is piped into the tank structure it can drain away by passing through the apertures and soaking into the surrounding soil.

2. The liquid run-off disposal system as defined in claim 1, wherein the louvre-shaped inserts are inserted into matching louvre-locating cavities from the outside of the culvert section so that they pass through the sidewall, protruding inwardly and extending upwardly from the inner surface of the sidewall into the inside of the culvert section.

3. The liquid run-off disposal system as defined in claim 2, wherein each louvre-shaped insert is of elongate configuration, having a substantially perpendicular face at each end; an outer face at an outer end that is open, in use, to the outside of the culvert section and which sits more or less flush with an outer surface of the sidewall, and an inner face at an inner end that is open, in use, to the inside of the culvert section.

4. The liquid run-off disposal system as defined in any claim 3, wherein the louvre-shaped insert is provided with a flange on its outer face designed to secure the insert in the louvre-locating cavity.

5. The liquid run-off disposal system as defined in claim 4, wherein the outer face of each louvre-shaped insert is facing downwards, and is partially shielded within its louvre-locating cavity.

6. The liquid run-off disposal system as defined in claim 5, wherein the flange is designed to engage with an annular ridge provided within each louvre-locating cavity, to create a clip-lock feature which holds the insert securely in position once installed.

7. The liquid run-off disposal system as defined in claim 4, wherein a part of the sidewall within the louvre-locating cavity, against which the flange of the louvre-shaped insert rests, turns at substantially a right-angle and returns back outwardly to a main outer surface of the sidewall.

8. The liquid run-off disposal system as claim 1, wherein the angled profile of the part of the sidewall that forms the louvre-locating cavity, is a zig-zag profile in cross-section.

9. The liquid run-off disposal system as defined in claim 1, wherein each culvert section is of generally parabolic or semi-elliptical cross-section.

10. The liquid run-off disposal system as defined in claim 9, wherein each culvert section has an open base.

11. The liquid run-off disposal system as defined in claim 1, wherein each culvert section is provided with a reinforcing rib extending over an external circumference of the section from a base to an apex.

12. The liquid run-off disposal system as defined in claim 11, wherein the reinforcing rib has a height dimension at the apex which is higher than a height of the sidewalls of the section, and a width dimension which is smaller at the apex than at the base.

13. The liquid run-off disposal system as defined in claim 12, wherein the reinforcing rib is of substantially rectangular cross-section, when viewed transversely of the rib, having an outer wall and two sidewalls.

14. The liquid run-off disposal system as defined in claim 13, wherein at the apex the height of the outer wall of the rib is between 15%-19% higher than the sidewalls of the section.

15. The liquid run-off disposal system as defined in claim 14, wherein at the apex the width of the outer wall of the rib is between 9% and 13% of the total length of the section.

16. The liquid run-off disposal system as defined in claim 15, wherein at the apex the width of the outer wall of the rib is approximately 11% of the total length of the section.

17. The liquid run-off disposal system as defined in claim 13, wherein at the apex the height of the outer wall of the rib is approximately 17% higher than the sidewalls of the section.

18. The liquid run-off disposal system as defined in claim 17, wherein at the base the width of the outer wall of the rib is between 35%-45% of the total length of the section.

19. The liquid run-off disposal system as defined in claim 18, wherein at the base the width of the outer wall of the rib is approximately 40% of the total length of the section.

20. The liquid run-off disposal system as defined in claim 1, wherein between one quarter to one half of the length of the respective upper and lower surfaces of the louvre-shaped inserts overlap, measured in a vertical direction.

21. The liquid run-off disposal system as defined in claim 20, wherein about one third of the length of the respective upper and lower surfaces overlap, measured in a vertical direction.

22. The liquid run-off disposal system as defined in claim 1, wherein the louvre-shaped inserts are provided in a uniform rectangular array comprising a plurality of rows and columns, the inserts in each row being arranged at spaced intervals, and the inserts in any row being offset horizontally from the inserts in an adjacent row.

23. The liquid run-off disposal system as defined in claim 1, further comprising one or more vertical liners arranged at predetermined locations on top of the culvert sections for maintenance purposes and/or human access.

24. The liquid run-off disposal system as defined in claim 23, wherein each liner is provided with a manhole cover or a grating for back-pressure relief and to collect stormwater from sealed surfaces other than a building.

25. The liquid run-off disposal system as defined in claim 1, wherein the first and second sidewalls each have a substantially constant thickness measured between the respective inner surface and outer surface.

26. The liquid run-off disposal system as defined in claim 1, wherein the louvre-shaped inserts are cylindrical in shape.

27. The liquid run-off disposal system as defined in claim 1, wherein the louvre-locating cavities are scallop-shaped when viewed in perspective, and are of increasing length as one moves up the sidewalls.

28. The liquid run-off disposal system as defined in claim 1, wherein each culvert section is provided with a flared base, formed by a lip extending along the respective longitudinal edges of the first and second sidewalls.

* * * * *